US005625990A

United States Patent [19]

Hazlett

[11] Patent Number: 5,625,990

[45] Date of Patent: May 6, 1997

[54] INERLOCKING GROUND COVERING ELEMENT

[76] Inventor: Darren G. Hazlett, 4902 Dry Oak Trail, Austin, Tex. 74749

[21] Appl. No.: 590,633

[22] Filed: Nov. 22, 1995

[51] Int. Cl.[6] ..... E04F 13/00

[52] U.S. Cl. ..... 52/311.2; 52/604; 404/42

[58] Field of Search ..... 52/589.1, 590.1, 52/311.1, 314, 315, 608, 604, 605, 311.2; 404/41, 42, 34; D25/130, 143

[56] References Cited

U.S. PATENT DOCUMENTS

| | | | |
|---|---|---|---|
| D. 263,082 | 2/1982 | Hass | D25/92 |
| D. 314,829 | 2/1991 | Brock | D25/113 |
| 3,873,225 | 3/1975 | Jakobsen | 404/41 |
| 4,514,113 | 4/1985 | Neumann | 405/286 |
| 4,583,341 | 4/1986 | Barth | 52/589 |
| 4,711,599 | 12/1987 | Glickman | 404/41 |
| 4,773,790 | 9/1988 | Hagenah | 404/41 |
| 5,286,139 | 2/1994 | Hair | 404/42 X |

OTHER PUBLICATIONS

Pavestone, Inc.: Color copies of Texas Shaped Paving Element and drawing of multiple units.

The American Heritage Dictionary, Second College Edition, 1982 pp. 69, 70, 465, 1190, 1526.

Photograph: "The State of Texas" Sign describing City of Austin, Texas Public Water System.

Standard Specifications for Construction and Maintenance of Highways, Streets, and Bridges, Texas Department of Transportation, Mar. 1, 1995, p. 7.

Texas Official Travel Map, Texas Department of Transportation, 1995.

Photographs: Abstract Texas, Bill board for AT&T Wireless Services.

*Primary Examiner*—Creighton Smith

[57] ABSTRACT

This invention provides an interlocking ground covering element, the shape of which is an abstraction of the shape of the state of Texas. The interlocking of multiple adjacent elements is obtained by the inherent projections and recesses comprising the element's shape. The elements can be used to cover horizontal surfaces as in paving or vertical surfaces as seen in retaining walls.

2 Claims, 4 Drawing Sheets

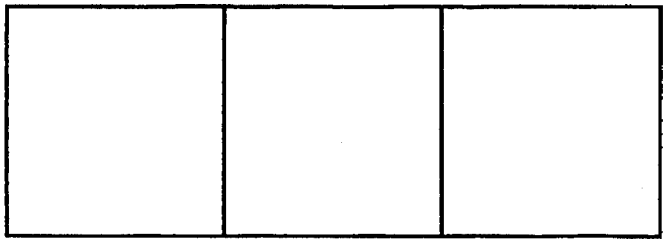
FIG. 2
FIG. 4
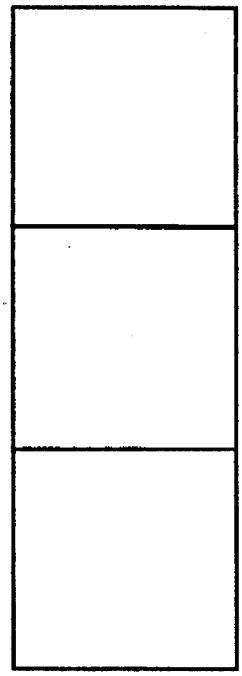
FIG. 1
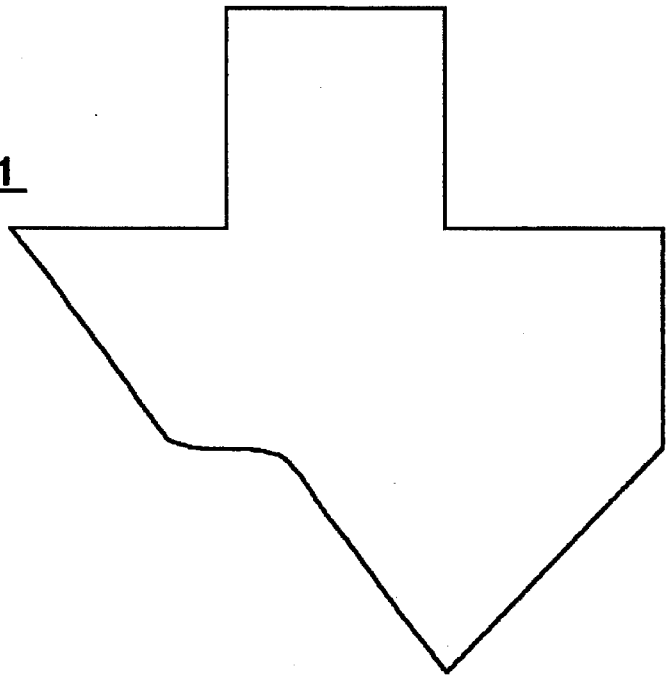
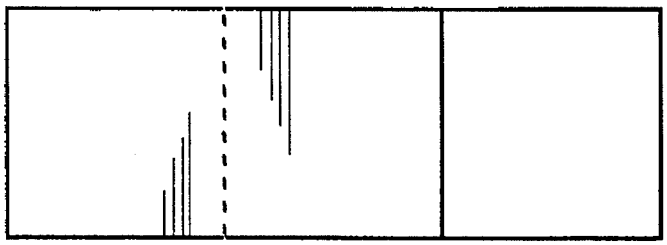
FIG. 3

INERLOCKING GROUND COVERING ELEMENT

BACKGROUND

1. Field of Invention

This invention relates to an interlocking ground covering element, the shape of which is an abstraction of the shape of the state of Texas.

2. Discussion of Prior Art

Ground covering elements are used for horizontal applications as paving stones, or in vertical applications as retaining wall elements. There are many designs for or ground covering elements to create walkways, driveways, patios, paths, retaining walls, etc. Designs fall into two basic groups: those that interlock with each other, and those which do not interlock but are given lateral support from surrounding units by point contact. Designs which interlock can be further subdivided into two groups: identical single size units which interlock due to some unique shape, and multiple unit designs which use two or more different shapes or sizes of elements to achieve the interlocking structure. Rarely do any of the interlocking designs use a shape which can be recognized as anything other than a geometric shape, combination of geometric shapes, curves, projections and recesses.

PRIOR ART

In U.S. Pat. No. 3,873,225, an interlocking paving stone design is described. This set of paving stones utilizes two shapes with projections on one of the shapes and recesses on the other. The set also has downwardly tapering sides on one shape and upwardly tapering sides on the other shape. The result of the combination of tapering sides, projections and recesses is the increase in mechanical interlocking of an assembled group of properly aligned units. In an assembled group of elements, the projections and recesses are hidden from the surface view, with the resulting group appearing as geometrical shapes.

U.S. Pat. No. 4,583,341, describes an interlocking paving stone design. This basic design consists of elements with a modified square shape. The square shape is modified to include interlocking projections and recesses formed by a saw-tooth design on the sides of the square or by sinusoidal curved shape sides. This patent describes the use of the shape in multiple element units with dummy gaps forming the element shape. Dummy gaps are surface markings which give the appearance of two or more individual units making up a larger unit. These can enable larger paving units to be constructed in which overloading will cause preferential breaking along the dummy gap or provide for faster or easier construction by the use of larger pieces. The visual presentation or configuration of elements is unchanged.

U.S. Pat. No. 4,711,599, describes a chevron shaped paving block which may have minor modifications such as rounded or chamfered edges. The reported benefit of this shape paving block is the interlocking of adjacent elements and the wide variety of paving patterns which can be formed.

U.S. Pat. No. 4,773,790, describes a ground covering element similar to those of U.S. Pat. No. 4,583,341. This patent utilizes some of the same shaped units but utilizes a "T" shaped larger element composed of three smaller paver shapes. The interior delineation of the three identical sub-elements are formed with dummy gaps. The shapes utilized include saw-toothed edged squares and rectangles and square shapes with modified sinusoidal curved shaped sides.

U.S. Design Patent No. 263,082 describes an offset, dog bone shaped paving stone unit. This design allows for the interlocking of adjacent units.

U.S. Design Patent No. 314,829 describes a interlocking paving stone with the shape of a cross or "plus sign". The paving stone interlocks with adjacent elements due to the inherent projections and recesses of the paving units shape.

In another use for interlocking shapes, U.S. Pat. No. 4,514,113 describes a hexagonal shape unit used to form the front wall panel members of an earth retaining wall system. The interlocking of adjacent hexagons prevents movement of the wall panel elements in the plane of the wall. Movement perpendicular to the plane of the wall is prevented by an anchor system incorporated into the earth backfill. This use of interlocking elements for retaining walls is analogous to paving units except that the anchoring system is needed to prevent out of plane movement on the vertical wall surface.

A Texas shaped paving stone is sold by Pavestone, Inc. The paving stone does not allow for easy construction within the confines of linear dimensions or rectangular construction areas. This design also does not allow for ease of obtaining border pieces to complete construction in a rectangular area. Individual partial elements must be cut in non-repeating, irregular units to fill out a rectangular construction area.

SUMMARY OF INVENTION - DESCRIPTION OF DRAWINGS

This invention relates to an interlocking ground covering element, the shape of which is an abstraction of the shape of the state of Texas. The interlocking of multiple adjacent elements is obtained by the inherent projections and recesses comprising the element's shape. The elements can be used to cover horizontal surfaces as in paving or vertical surfaces as seen in retaining walls.

FIG. 1 illustrates in plan an example of the interlocking ground covering element of this invention. It is in this view that the abstract shape of Texas is seen.

FIG. 2 an end elevation of the element in FIG. 1.

FIG. 3 is an end elevation of the element in FIG. 1 as viewed from the opposite end from FIG. 3.

FIG. 4 is a side elevation of the element in FIG. 1.

Figure 5:
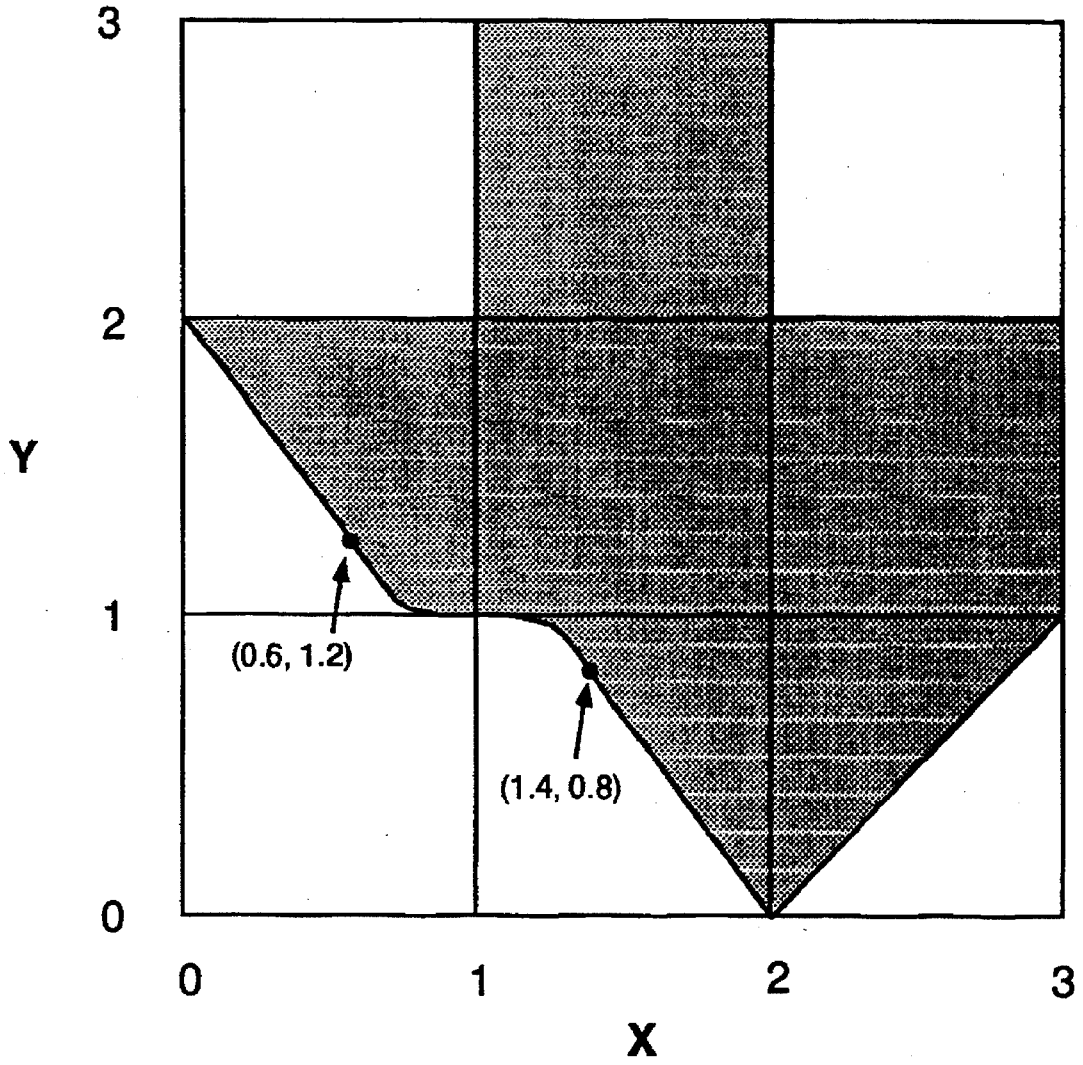

FIG. 5 shows that the unique interlocking design is based on the abstract shape of the state of Texas capable of being contained within a three unit by three unit (3×3) square, where element components are formed from individual one by one (1×1) subunits or partial subunits. FIG. 5 shows that the perimeter of said Texas shape design can be described by connecting points, using lines and a curve, within a three unit by three unit square using an x-y Cartesian coordinate system. Lines connect the following points successively: (1.4,0.8), (2,0), (3,1), (3,2), (2,2), (2,3), (1,3), (1,2), (0,2), and (0.6,1.2). The perimeter is closed by connecting points (0.6, 1.2) and (1.4, 0.8) by a curve approximated by a third order polynomial with an inflection point and point of zero slope at (1,1).

Figure 6:
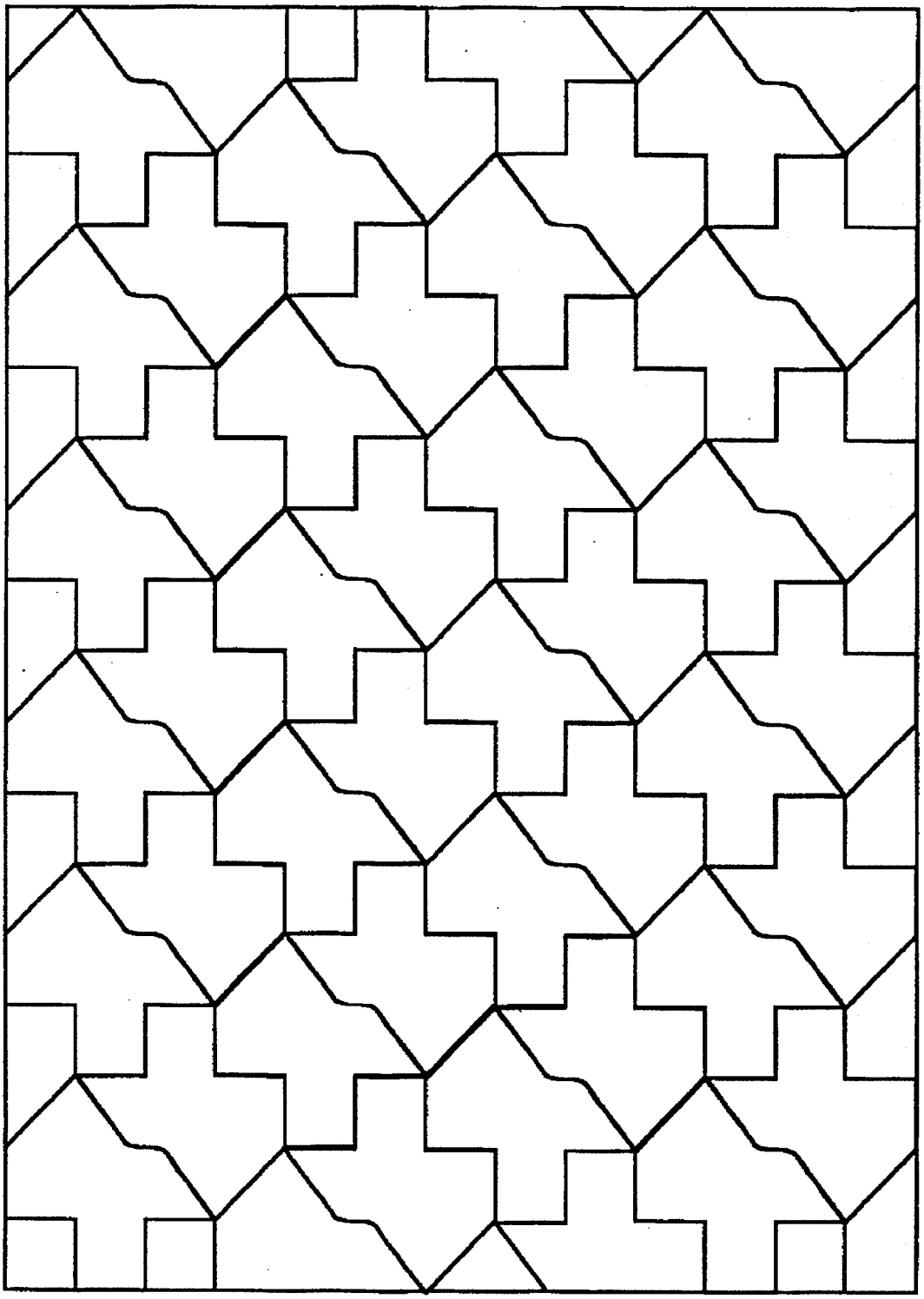

FIG. 6 shows, in plan view, the interlocking pattern which can be formed from multiple elements according to the invention and the regular repeating shapes of partial subunits needed to fill out a rectangular area.

Figure 7:
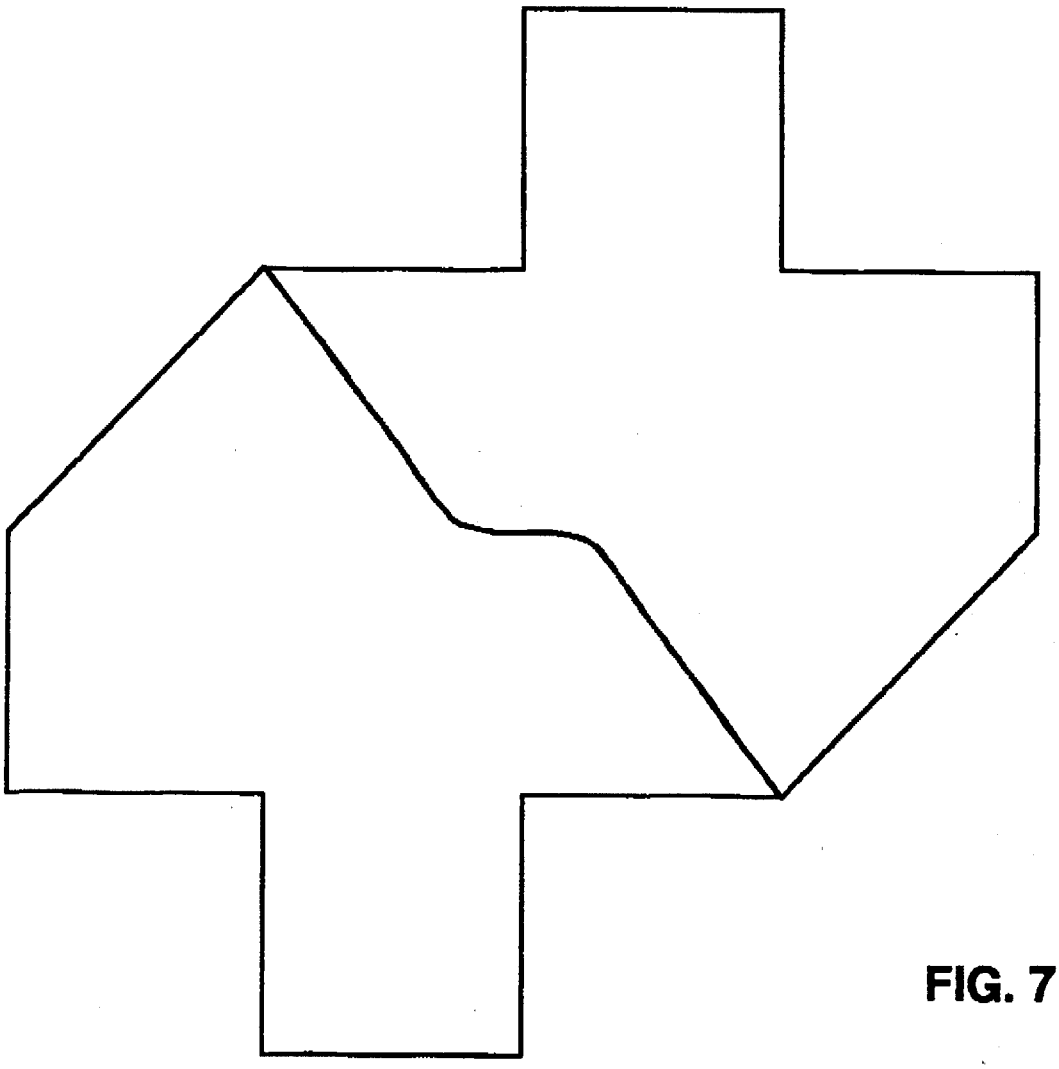

FIG. 7 illustrates in plan a two element unit variation of the design composed of two of the Texas shapes. The interior lines and curve are formed by a dummy-gap to simulate the two Texas shaped units.

It is this unique design and dimensions which enables multiple units, when assembled, to conform to linear construction limits. Partial units are easily cast or may be cut from whole elements to complete the design and conform to linear dimensions or rectangular construction areas. Partial units needed to fill linear or rectangular construction dimensions are repeating and regular.

FIG. 6 shows, in plan view, the interlocking pattern which can be formed from multiple elements according to the invention and the regular repeating shapes of partial subunits needed to fill out a rectangular area.

Other variations or modifications to the original design may be made without changing the basic invention. As an example, edges of the element of this invention as seen in plan view could be squared, as seen in the drawings, chamfered or radiused. The surface of the Texas shape (FIG. 2) can be have a smooth or textured finish. Also, the size of elements can be scaled to suit specific purposes. Element size for a paving stone would more conveniently be larger than that shown in the figures. Further scale up could be made to accommodate interlocking wall elements in an earth retaining wall. In addition, the design can incorporate integral spacing nodes to aide in placement of units during construction or channeled edges to aide in out-of-plane stability as needed for some retaining walls.

FIG. 7 illustrates in plan a two element unit variation of the design composed of two of the Texas shapes. The interior lines and curve are formed by a dummy-gap to simulate the two Texas shaped units. This panel design would be useful for retaining wall construction. The resulting wall element would have the same construction advantages as the individual unit shape, namely easy conformation to linear or rectangular construction dimensions, but be easier to place adjacent units since curved sections would not need to be matched up on the construction site.

Similarly multiple element units could be formed utilizing more than two individual elements, with dummy gaps delineating individual element shapes.

I claim:

1. An interlocking ground covering element, substantially larger in horizontal dimensions than it is thick, a plan view of which is based on an abstract shape of a state of Texas, capable of being contained within a three (3) unit by three (3) unit space, with element components formed from individual one (1) by one (1) subunits or partial subunits.

2. An interlocking ground covering element comprised of two or more connected ground covering elements of claim 1 connected to one another, and at least one dummy gap delimiting the connected ground covering elements of claim 1 from one another.

* * * * *